United States Patent [19]

Sumita

[11] 4,452,544

[45] Jun. 5, 1984

[54] MECHANICAL PENCIL WITH AUTOMATIC LEAD FEED

[75] Inventor: Yo Sumita, Tokyo, Japan

[73] Assignee: Pilot Precision Kabushiki Kaisha, Hiratsuka, Japan

[21] Appl. No.: 372,241

[22] Filed: Apr. 26, 1982

[30] Foreign Application Priority Data

Apr. 28, 1981 [JP] Japan ..... 56-65728[U]

[51] Int. Cl.[3] ..... B43K 21/02

[52] U.S. Cl. ..... 401/53; 401/65; 401/67; 401/81; 401/94

[58] Field of Search ..... 401/53, 54, 80, 81, 401/65, 67, 94

[56] References Cited

U.S. PATENT DOCUMENTS

| | | | |
|---|---|---|---|
| 267,309 | 11/1982 | Hoffman | 401/53 |
| 2,469,411 | 5/1949 | Robbins | 401/67 |
| 2,865,330 | 12/1958 | Swank | 401/53 |
| 3,076,437 | 2/1963 | Johnson | 401/53 |
| 3,864,046 | 2/1975 | Butka | 401/53 |
| 4,180,339 | 12/1979 | Katz | 401/67 |
| 4,275,971 | 6/1981 | Katz | 401/80 |

FOREIGN PATENT DOCUMENTS

| | | | |
|---|---|---|---|
| 2153400 | 5/1973 | Fed. Rep. of Germany | 401/67 |
| 2611608 | 9/1977 | Fed. Rep. of Germany | 401/81 |

*Primary Examiner*—Steven A. Bratlie

*Attorney, Agent, or Firm*—Wenderoth, Lind & Ponack

[57] ABSTRACT

A mechanical pencil with automatic lead feed has a clamping mechanism for clamping a lead in such a manner that it holds the lead steadily against rearward movement but easily permits the lead to move forwardly. A lead tube is fixed at its rear end to the front end of a housing to guide and protect the lead. A sensor is slidably held in the front end of the housing and extends along the lead tube to sense the wear of the lead during writing. A lead advancing mechanism is actuated by the sensor and has a holder for frictionally holding the lead and an elastic member for urging the holder forwardly.

4 Claims, 11 Drawing Figures

MECHANICAL PENCIL WITH AUTOMATIC LEAD FEED

BACKGROUND OF THE INVENTION

This invention relates to a mechanical pencil in which a pencil lead can be automatically advanced at a rate corresponding to the wear of the lead during writing.

Such a mechanical pencil with automatic lead feed during writing is already known from U.S. Pat. No. 4,180,339 in which the mechanical pencil has a tubular housing accommodating a lead magazine in its rear portion and a chuck or clamping mechanism in its front portion for releasably clamping the lead in response to its movement in its axial direction. To the front end of the housing is connected a conical member for guiding the lead, at the tapered front end of which a small lead tube is slidably mounted. The lead passes through the lead tube until the front end of the former reaches the front end of the latter. As the lead tube always touches the surface of a sheet of paper at its front end during writing with the lead, it is gradually moved rearwardly, by a repulsive force from the surface of the paper during writing, in response to the wear of the lead.

To the rear end of the lead tube is fixedly connected a lead holder for holding the lead in such a manner that it can slidably retract on the lead during writing. A coil spring provided in the conical member is compressed while the lead is being clamped by the clamping mechanism, which can hold the lead to advance the lead under the repulsive force of the spring, the clamping mechanism releasing the lead when the front end of the lead is separated from the paper surface.

In such a construction, the lead tube functions as a guide member for the lead and a sensor for sensing the wear of the lead during writing. For these purposes, the lead tube is adapted to slide through a bore in the front end of the conical member. Therefore, the lead tube cannot hold the lead with sufficient resistance against bending forces exerted on the lead when the mechanical pencil is used at a large angle, especially more than 75 degrees of angle of inclination. In addition, when the bending forces are exerted on the front part of the lead, the lead tube slightly slants with respect to the longitudinal axis of the pencil whereby a part of the outer circumferential surface of the lead tube is apt to stick to the inner surface of the bore to cause obstruction of smooth movement of the lead tube. Accordingly, a user has an unpleasant feel during writing, and the front end of the tube is worn, whereby two sharp corners are formed on respective sides, in the radial direction, of the face of the front end. This often gives rise to tearing of the paper. To avoid wear of the lead tube, a piece of super hard alloy or ruby is often attached to the front end of the lead tube.

SUMMARY OF THE INVENTION

It is an object of this invention, in view of the above described circumstance, to provide a mechanical pencil with automatic lead feed in which a lead tube can hold the lead with sufficient resistance against bending forces exerted thereon, and a sensor for sensing the wear of the lead during writing and actuating a lead advancing mechanism can smoothly retract in response to its wear, whereby a user can write smoothly without feeling scratching on the surface of the paper.

According to this invention, there is provided a mechanical pencil with automatic lead feed comprising: a housing means; a lead clamping mechanism provided in the housing means and clamping a lead in such a manner that it holds the lead steadily against rearward movement but easily permits the lead to move forwardly; a lead tube fixed at its rear end portion to the front portion of the housing means to guide the lead and protect the lead against bending forces exerted thereon; a lead advancing mechanism provided in front of the lead clamping mechanism and having a holder for frictionally holding the lead and an elastic member for urging the holder forward; and a sensor slidably held at its rear end in the front end of the housing means and projecting forward along the lead tube to the extreme front end of the projecting lead, the sensor operating to so actuate the lead advancing mechanism that it retracts in response to the wear of the lead during writing, moving the holder rearwardly, to compress the elastic member, along the lead held steadily by the lead clamping mechanism, the holder being subsequently pushed forwardly by the repulsive force of the elastic member while holding the lead when the front end of the lead is separated from the surface of the paper.

The nature, utility, and further features of this invention will be more clearly apparent from the following detailed description with respect to preferred embodiments of the invention when read in conjunction with the accompanying drawings briefly described below.

DETAILED DESCRIPTION OF THE INVENTION

Figure 1:
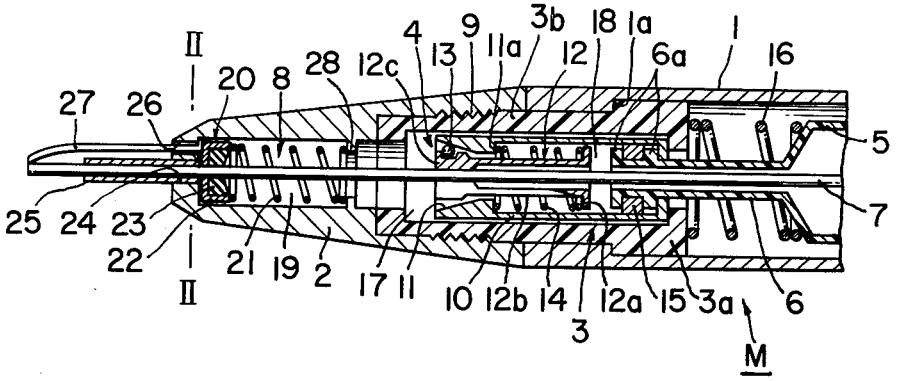
FIG. 1 is a side view, in longitudinal section, showing essential parts of one example of a mechanical pencil according to the present invention.
Figure 2:
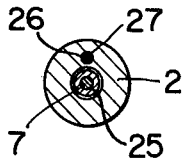
FIG. 2 is a cross section taken along the line II—II in FIG. 1.

Referring first to FIGS. 1 and 2, the mechanical pencil M shown therein has a tubular housing 1 provided at one end with a conical nose member 2 which is releasably connected to the front end of the housing 1 via a connecting sleeve 3. In the connecting sleeve 3 is provided a chuck or clamping mechanism 4 for releasably clamping a pencil lead 7 and to which a lead magazine 5 is connected through a guide sleeve 6 for guiding the lead 7 toward the front part of the pencil M. In the nose member 2 and in front of the clamping mechanism 4, there is provided a lead advancing mechanism 8 for advancing the lead in response to the wear of the lead during writing.

The connecting sleeve 3 has at its rear end a stopping part 3*a* of a relatively large diameter having a front ledge which abuts against a shoulder 1*a* formed at the front end portion of the tubular housing 1. The front portion of the connecting sleeve 3 is a connecting part 3*b* of a smaller diameter than the stopping part 3*a*. The front portion of the connecting part 3*b* which projects forward from the front end of the housing 1 is inserted and screwed into the conical nose member 2, the two members 2 and 3*b* being engaged with each other by a threaded part 9.

The clamping mechanism 4 has a fastening sleeve 10 with a concave frustoconical guide face 11, at its front end portion, tapering in such a manner that its diameter gradually decreases toward the rear and a clamping member 12 for releasably clamping the lead 7 disposed therein. The clamping member 12 is, in general, in the form of a tube and has a base flange 12*a* at its rear end and a number of clamping arms 12*b*, 12*b*, . . . 12*b* branching forward from the base flange 12*a* along the lead 7. At the front end of each of the arms 12*b* is formed a clamping jaw or head 12*c* having a ball 13 on its outer surface. The clamping member 12 is made of elastic material, and each clamping head 12*c* is adapted to open and close in the radial direction of the clamping member 12, cooperating in a wedge action with the frustoconical guide face 11 via each ball 13. Furthermore, the clamping member 12 is urged rearwardly, with respect to the fastening sleeve 10, by a weak compression coil spring 14 provided between the base flange 12*a* and a shoulder 11*a* at the rear end of the guide face 11.

Into the rear portion of the fastening sleeve 10 is inserted the front end of the guide sleeve 6, at which end a friction ring 15 is held between two flanges 6*a*,6*a*. The guide sleeve 6 is urged rearwardly by a compression coil spring 16 provided between the rear end face of the connecting sleeve 3 and the front hopper-like portion of the magazine 5. Accordingly, in the normal or standard state of the pencil as shown in FIG. 1, the fastening sleeve 10 is retracted so as to form a space 17 between the front end of the fastening sleeve 10 and a rearwardly facing inner ledge at the front end of the connecting sleeve 3 and a space 18 between the base flange 12*a* of the clamping member 12 and the front end of the guide sleeve 6. An actuating button (not shown) is provided at the rear end of the magazine 5, which button is pushed to advance the lead before writing.

In the front part of the conical nose member 2 is provided a cylindrical space 19 accommodating a lead holder 20 for holding the lead and a compression coil spring 21 for biasing the lead holder 20 forward. The coil spring 21 exerts a greater spring force than the coil spring 14 and is interposed between an annular inward projection 28 of the nose member 2 and the rear end of the lead holder 20. The holder 20 comprises a casing 22 in the shape of a cup and a holding rubber 23, inserted into the casing 22, for holding the lead 7 in such a manner that it can slide on the lead in the rear direction when the lead 7 is clamped by the clamping mechanism 4, while it can advance the lead under the forwardly directed force of the compressed coil spring 21 when the lead is released by the clamping mechanism 4 as described in detail hereinafter.

A bore 24 is provided in the front end of the conical nose member 2, in which bore 24 the rear end of a lead tube 25 for guiding the lead 7 and holding it to resist bending forces exerted thereon during writing is inserted and fixedly held. A hole 26 of a small diameter is formed in the longitudinal direction in the nose member 2 at a position above and spaced apart from the bore 24. Through this hole 26 the rear end of a sensor 27 having elasticity such as a piece of piano wire is inserted and slidably held. The front end portion of the sensor 27 is slightly arched so as to approach the front end of the lead 7, while the rear end of the sensor 27 is bent so as to abut against the front end face of the holder 20.

The operation of the mechanical pencil of the above described construction according to this invention is as follows.

Figure 3:
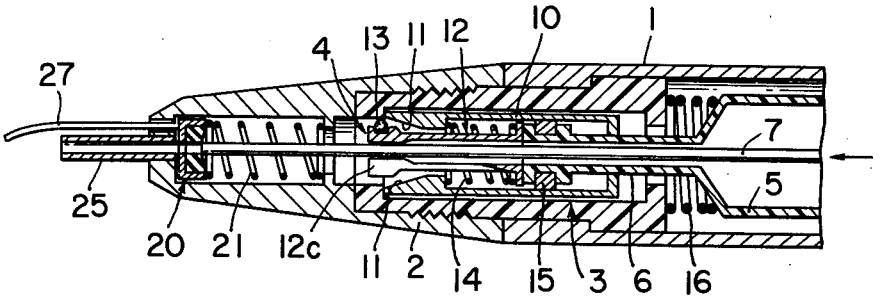
FIG. 3 through FIG. 7 are side views, in longitudinal section similar to FIG. 1 indicating the operation of the mechanical pencil according to this invention, FIG. 3 showing the state in which an actuating button is pushed to feed a lead into the front portion of the pencil, FIG. 4 showing the state in which the actuating button is released after the lead is fed to the front part of the pencil, FIG. 5 showing the state in which the actuating button is pushed again to feed the lead forward through a lead holder, FIG. 6 showing the state in which a sensor is moving the holder rearwardly during writing, and FIG. 7 showing the state in which the lead is advanced immediately after the pencil is separated away from the surface of a sheet of paper.

When a new length of lead 7 is fed to the front portion of the pencil M through the clamping mechanism 4, the actuating button (not shown) provided at the rear end of the magazine 5 is pushed into the housing 1 or forward in order to open the clamping mechanism 4. That is, the pushing of the actuating button causes the guide sleeve 6 to advance together with the fastening sleeve 10 because of frictional engagement between the friction ring 15 and the inner surface of the fastening sleeve 10 until the front end of the fastening sleeve 10 abuts against the inner front end of the connecting sleeve 3. Thereafter, only the front end of the guide sleeve 6 advances with the friction ring 15 sliding along the inner wall surface of the fastening sleeve 10 until the front end of the guide sleeve 6 abuts against the base flange 12*a* of the clamping member 12, whereupon the clamping member 12 is pushed forward by the guide sleeve 6 thereby to open the clamping arms 12*c* as the compression coil spring 14 is compressed. Accordingly, the lead 7 can pass through the clamping mechanism 4 under gravity until the front end of the lead 7 contacts the rear end of the holder 20. FIG. 3 shows this state.

Figure 4:
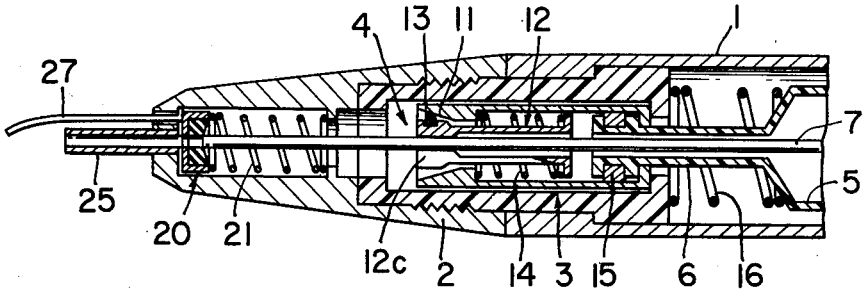

When the actuating button is released after the lead 7 has been fed to the holder 20, the guide sleeve 6, the fastening sleeve 10 and the clamping member 12 are retracted to the standard position by the repulsive forces of the coil springs 16 and 14, respectively, as shown in FIG. 4.

Figure 5:
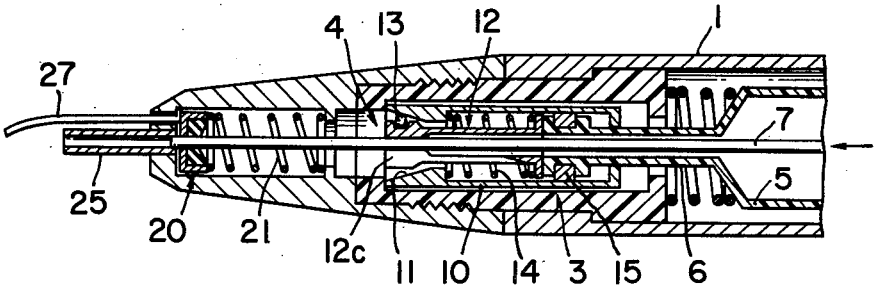

Then, when the guide sleeve 6 is moved forward again by the actuating button, the front end of the lead 7 can pass through the holder 20 as shown in FIG. 5. With the succeeding advancement of the guide sleeve 6, the fastening sleeve 10 moves forward with the clamping mechanism 4 holding the lead 7 to cause the front end of the lead 7 to thrust through the holder 20. FIG. 5 shows the state at this moment. The lead 7 is gradually advanced intermittently, by the repetition of the pushing movement of the actuating button, until the lead 7 projects to the front end of the sensor 27 from the lead tube 25 as shown in FIG. 1.

Figure 6:
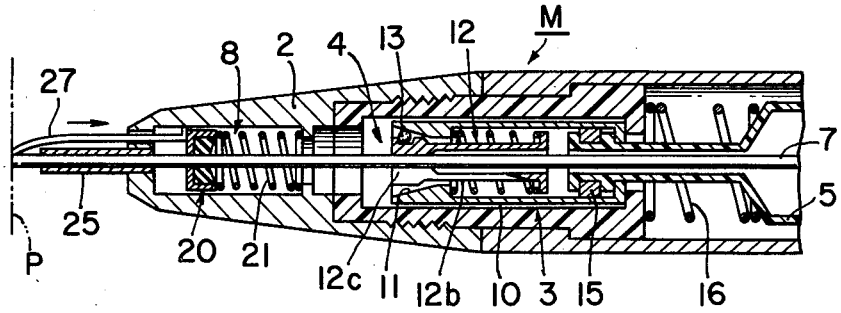

FIG. 6 shows the state in which a user is writing with the pencil M. The front end of the lead 7 is gradually worn during writing. As a reaction force from the paper P is exerted on the lead during writing, the lead 7 tends to move rearwardly. However, at that time, the clamping arms 12*b* move rearwardly with the balls 13 on the heads 12*c* of the clamping arms 12*b* slightly rolling on the frustoconical face 11 of the fastening sleeve 10 to tightly close the heads 12*c* whereby the lead 7 is tightly held by the clamping mechanism 4.

Figure 7:
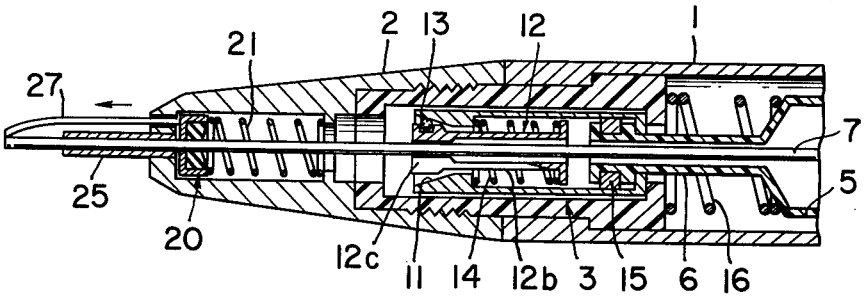

In response to the wear of the lead 7, the sensor 27 retracts rearwardly to push or move back the holder 20 and cause the coil spring 21 to be compressed as shown in FIG. 6. When the front end of the pencil M is separated away from the paper after the user writes some words, the elastic holder 20 is advanced, holding the lead 7 and pushing forward the sensor 27, by the repulsive force of the coil spring 21 to the front end of the space 19 of the conical nose member 2 as shown in FIG. 7. At this moment, the clamping member 12 is advanced slightly by the lead 7, with the balls 13 rolling on the frustoconical face 11 thereby to open the clamping arms 12*b*. As the clamping arms 12*b* can be opened by a very small force directed forward because of the clamping mechanism 4 in the form of a collet chuck, and the coil spring 21 is exerting a greater force than the coil spring 14, the holder 20 can advance the lead 7 smoothly.

In this pencil M, since the sensor 27 for sensing the wear of the lead 7 and operating the lead advancing mechanism 8 is provided in addition to the lead tube 25, fixed to the front end of the conical member 2, for guiding the lead 7 and holding and protecting it against bending forces, the lead tube 25 can hold the lead 7 steadily and the sensor 27 can move smoothly, whereby the user can write smoothly and pleasantly without feeling scratching of the paper.

Other embodiments of this invention are described hereinbelow.

Figure 8:
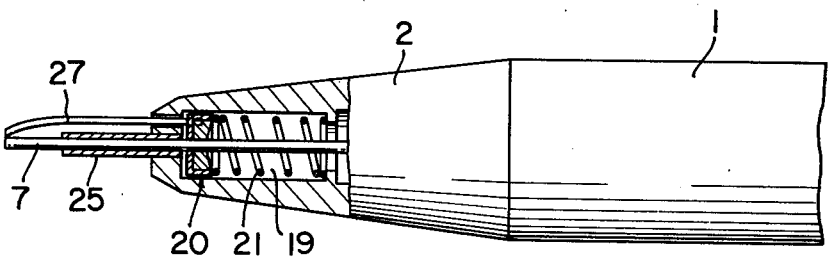
FIG. 8 and FIG. 9 are side views, partly in longitudinal section, respectively showing two different modifications of the mechanical pencil according to this invention.

In FIG. 1, the rear end of the sensor 27 abuts against the front face of the holder 20. However, the rear end of the sensor 27 may be fixed to the holder 20 as shown in FIG. 8.

Figure 9:
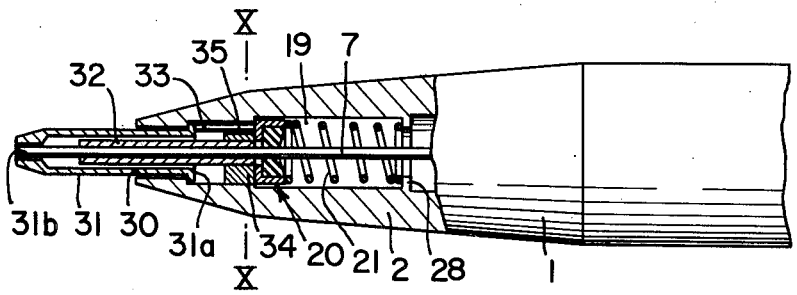
Figure 10:
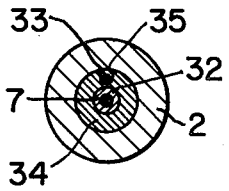
FIG. 10 is a cross section taken along the line X—X in FIG. 9.

In FIGS. 9 and 10, at the front end of the conical nose member 2 is provided a somewhat large bore 30 in which a sensor 31 in the form of a tube is slidably held. The sensor 31 has a stop flange 31*a* at its rear end, which contacts and is stopped by the inner end face of the conical nose member 2, whereby the sensor 31 is prevented from slipping out of the conical nose member 2. The front end of the sensor 31 is convergently tapered toward the front, and the lead 7 extends to the extreme front end of the sensor 31 through a hole 31*b* formed therein. A lead tube 32 is inserted into the sensor 31, the rear end portion of which is fixed to a fixing member 34 fixedly mounted in the front portion of the conical nose member 2. The holder 20 biased forward by the compression coil spring 21 abuts against the fixing member 34, and a connecting rod 33 slidably held by a hole 35 formed in the fixing member 34 is provided between the stop flange 31*a* and the holder 20, the two ends of the connecting rod 33 abutting against the stop flange 31*a* and the holder 20, respectively. However, they may be respectively fixed thereto.

Figure 11:
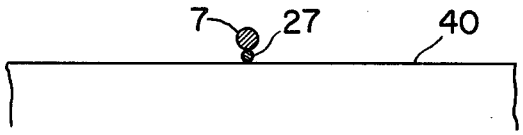
FIG. 11 is a diagrammatic view showing the state in which a line is drawn with the pencil as shown in FIG. 1 along an edge of a rule.

During writing with this pencil, the sensor 31 retracts in response to the wear of the lead 7 to cause the holder 20 to slide away from the fixing member 34 via the connecting rod 33. When the front end of the lead 7 is separated from the paper, the holder 20 is advanced by the repulsive force of the coil spring 21, holding the lead 7 as described above. If the sensor 31 is formed in the shape of a tube as described above, it can protect more completely the portion of the lead 7 projecting from the front end of the lead tube 32 in comparison with the sensor 27 in the shape of a wire. Furthermore, when a line is drawn along a rule 40 with the pencil M having the wire-shaped sensor 27, if it is drawn in contact with the rule 40 as shown in FIG. 11, it cannot be drawn straight because the sensor 27 is apt to vibrate in the direction of the rule 40 during drawing. However, the tube-shaped sensor 31 does not have such a drawback.

I claim:

1. A mechanical pencil with automatic lead feed comprising:

a housing having a forward portion;

lead clamping means, positioned within said housing, for clamping a lead in such a manner as to hold the lead steadily against rearward movement but to permit easy forward movement of the lead;

means for guiding movement of the lead and for protecting the lead against bending forces exerted thereon, said means comprising a lead tube having a rear end fixed to said forward portion of said housing;

lead advancing means, positioned forwardly of said lead clamping means, for advancing the lead forwardly through said lead tube, said lead advancing means comprising holder means for frictionally holding the lead and elastic means for urging said holder means forwardly; and means for, upon wear of the lead during writing, moving said holder means rearwardly along the lead held by said clamping means and thereby compressing said elastic means, whereby upon subsequent separation of the lead from a writing surface, said elastic means urges forwardly said holder means and the lead held thereby, said moving means comprising a sensor separate from said lead tube, said sensor having a rear end slidably extending through said forward portion of said housing and a front end projecting forwardly along the lead to the extreme front end thereof, whereby as the lead is worn during writing said sensor slides inwardly of said housing and moves said holder means rearwardly.

2. A mechanical pencil according to claim 1, wherein said sensor comprises an elastic wire, said rear end of which abuts against said holder means.

3. A mechanical pencil according to claim 1, wherein said sensor comprises an elastic wire, said rear end of which is fixed to said holder means.

4. A mechanical pencil according to claim 1, wherein said sensor comprises a tube-shaped member slidably held at said rear end thereof in said forward portion of said housing, a front portion of said lead tube being inserted into said tube-shaped member, said rear end of said lead tube being fixed to a fixing member positioned forwardly of said holder means, and a connecting rod slidably extending through said fixing member and connecting said rear end of said tube-shaped member with said holder means, the two ends of said connecting rod abutting against or being fixed to said tube-shaped member and said holder means, respectively.

* * * * *